US005196895A

United States Patent [19]

Setoriyama et al.

[11] Patent Number: 5,196,895

[45] Date of Patent: Mar. 23, 1993

[54] HEATING APPARATUS USING ENDLESS FILM

[75] Inventors: Takeshi Setoriyama; Akira Kuroda, both of Yokohama, Japan

[73] Assignee: Canon Kabushiki Kaisha, Tokyo, Japan

[21] Appl. No.: 835,373

[22] Filed: Feb. 14, 1992

[30] Foreign Application Priority Data

Feb. 15, 1991 [JP] Japan ..... 3-044334
Feb. 15, 1991 [JP] Japan ..... 3-044335
Jun. 21, 1991 [JP] Japan ..... 3-177195

[51] Int. Cl.[5] ..... G03G 15/20

[52] U.S. Cl. ..... 355/285; 219/216; 355/290

[58] Field of Search ..... 355/282, 285, 289, 290; 198/814, 840, 843; 219/216, 388

[56] References Cited

U.S. PATENT DOCUMENTS 5,027,160 6/1991 Okada et al. ..... 355/282
5,052,547 10/1991 Doi ..... 198/814 X
5,119,143 6/1992 Shimura ..... 355/289

*Primary Examiner*—Joan H. Pendegrass
*Attorney, Agent, or Firm*—Fitzpatrick, Cella, Harper & Scinto

[57] ABSTRACT

A heating apparatus includes a heater; an endless film; a back-up member cooperative with the endless film to form a nip therebetween, wherein a recording material is conveyed with its lateral end aligned with a conveyance reference and has an image thereon, which is heated by heat from the heater; wherein a lateral shifting force of the endless film when the recording material is not passed through the nip is directed always toward the conveyance reference.

27 Claims, 12 Drawing Sheets

HEATING APPARATUS USING ENDLESS FILM

FIELD OF THE INVENTION AND RELATED ART

The present invention relates to a heating apparatus for heating through an endless film an image on a recording material to fix the image or improve the surface property of the image.

As for a conventional recording material heating apparatus for heat-fixing an image on the recording material, there is known a heat-roller type comprising a heating roller maintained at a predetermined temperature and a pressing roller having an elastic layer press-contacted to the heating roller, in which the rollers cooperate with each other to form a nip therebetween through which the recording material is passed. This apparatus requires that the temperature of the heating roller is maintained precisely at a predetermined temperature, and therefore, the thermal capacity of the heating roller can not be reduced very much. This results in a long waiting time to increase the temperature of the heating roller up to a predetermined temperature, during which the fixing operation is prohibited. U.S. Ser. Nos. 206,767, 446,449, 444,802, 560,760, for example, which have been assigned to the assignee of this application have proposed a heating apparatus using a quick response heater and a thin film.

Referring first to FIG. 9, there is shown an example of the heating apparatus using the endless film, in cross-section. A heat resistive film 51 in the form of an endless belt, which hereinafter will be called "fixing film" or "film", is extended around three members 52, 53 and 54, i.e., a left side driving roller 52, a right follower roller 53 and a low thermal capacity linear heater 54 disposed below a bottom travel of the film between the driving roller 52 and the follower roller 53, the longitudinal axes of the three members being parallel with each other.

The clockwise rotation of the driving roller 52 rotates in the clockwise direction at a predetermined peripheral speed, that is, substantially the same speed (process speed) as the member to be heated in the form of a recording material sheet P having an unfixed toner image Ta on the surface discharged from an unshown image forming station.

A pressing roller 55 (pressing member) is urged by an unshown urging means to the bottom surface of the heater 54 with the bottom travel of the fixing film 51 therebetween. The pressing roller 55 rotates in the same peripheral direction as the recording sheet P, that is, it rotates in the counterclockwise direction.

The low thermal capacity linear heater 54 extends in a direction crossing with the surface movement of the film 51 (the direction of the width of the film), and comprises a heater base (base member) 56, heat generating resistor 57 generating heat upon electric power supply thereto, surface protection layer 58 and temperature detecting element 59. It is fixedly mounted on a supporting member 61 through an insulating material 60.

The recording sheet P carrying thereon an unfixed toner image Ta is guided by a guide 62 and enters the nip between the heater 54 and the pressing roller 55, more particularly, between the fixing film 51 and the pressing roller 55 and passes through the nip together with the film 51 in close contact to the bottom surface of the fixing film 51 which rotates at the same speed as the sheet P conveying speed.

The heater 54 is energized at the predetermined timing to generate the thermal energy which is transferred through the film 51 to the recording sheet P which is closely contacted to the film. The toner image Ta is heated to a softened or fused image Tb while it is passed through the nip N.

The rotating fixing film 51 is abruptly deflected at an edge S having a large curvature of the insulating material 60. Therefore, the recording sheet P coming thereto through the nip N together with the fixing film 51, is separated from the fixing film 51 at the edge S by the curvature. Until the sheet reaches the discharging position, the toner is sufficiently cooled and solidified, and is completely fixed on the recording sheet P as the fixed image Tc.

However, when the endless film is used, it is very difficult to establish complete parallelism among the longitudinal axes of the driving roller 52, the follower roller 53 and the heater 54, and therefore, the production of lateral shifting force to the endless film is unavoidable. Depending on the endless film position in the width direction, the conveying force balance of the film is disturbed, or the pressure during the heat-fixing becomes uneven, or the temperature distribution of the heater results. It would be considered that the position of the endless film is limited within a predetermined range by displacing the tension roller by a solenoid or the like on the basis of detection of the film position. This, however results in an increase in the number of parts of the apparatus and in the bulky apparatus. In order to limit the lateral shifting of the film, it would be simple to limit a lateral end of the film by abutting it to a limiting member. Since, however, the film moves while the lateral end abuts the limiting member, the lateral end portion of the film which is thin and not rigid is easily creased, damaged or yielded when the lateral shifting force of the film is large. In other words, the durability of the end of the film is not sufficient. In U.S. Ser. No. 560,760, there is disclosed an apparatus wherein the endless film is driven by the pressing member, and the recording material is supplied while its lateral end is aligned with a reference. In such a case, when a small size recording material having a width smaller than the effective width of the film (maximum usable width), the film laterally shifts toward the sheet absent side. This is because in the sheet present region, the film is driven by the pressing roller through the recording material, whereas in the sheet absent region, it is directly driven by the pressing member, and therefore, the film conveying force is stronger in the sheet absent region than in the sheet present region, and therefore, the film receives the lateral shifting force toward the sheet absent region when the size of the recording material is small. Therefore, when small size sheets are continuously used, the film shifts significantly to the sheet absent region with the possible result of the damage of the lateral end of the film. When an endless film and a pressing roller form a nip and when the pressing roller is driven by a gear at one end, the adjustment is made when they are not driven, so that the pressure between the heater and the pressing roller is uniform at the opposite ends, i.e., the driven side where the driving force is transmitted to the pressing roller and the non-driven side where the driving force is not transmitted. Even if this is done, the reaction force resulting from the drive transmission by the gear during the driving makes the forces uneven. More particularly, the pressure P1 at the driving side is lower than the pressure P2 at the non-driven side (P1<P2). Therefore, when the apparatus is driven, the film is laterally shifted to the non-driven side where the pressure is high.

SUMMARY OF THE INVENTION

Accordingly, it is a principal object of the present invention to provide a heating apparatus wherein the endless film is prevented from being damaged.

It is another object of the present invention to provide a heating apparatus in which the film is protected from damage even if the recording material is supplied with its one lateral end aligned with a reference.

It is a further object of the present invention to provide a heating apparatus for limiting the lateral shifting direction of the endless film in one direction.

It is a yet further object of the present invention to provide a heating apparatus in which the endless film when the recording material is not passed, is directed always to the conveyance reference side.

It is a further object of the present invention to provide a heating apparatus including a heater, a back-up rotatable member and driving means for driving the back-up member at its longitudinal end, wherein the pressure between the heater and the backup rotatable member when the back-up rotatable member is not driven is larger at the driven side than at the non-driven side.

It is a further object of the present invention to provide a heating apparatus including a heater, an endless film and a driving rotatable member for driving the endless film, wherein the circumferential length of the driving rotatable member increases from one end toward the opposite end.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 8:
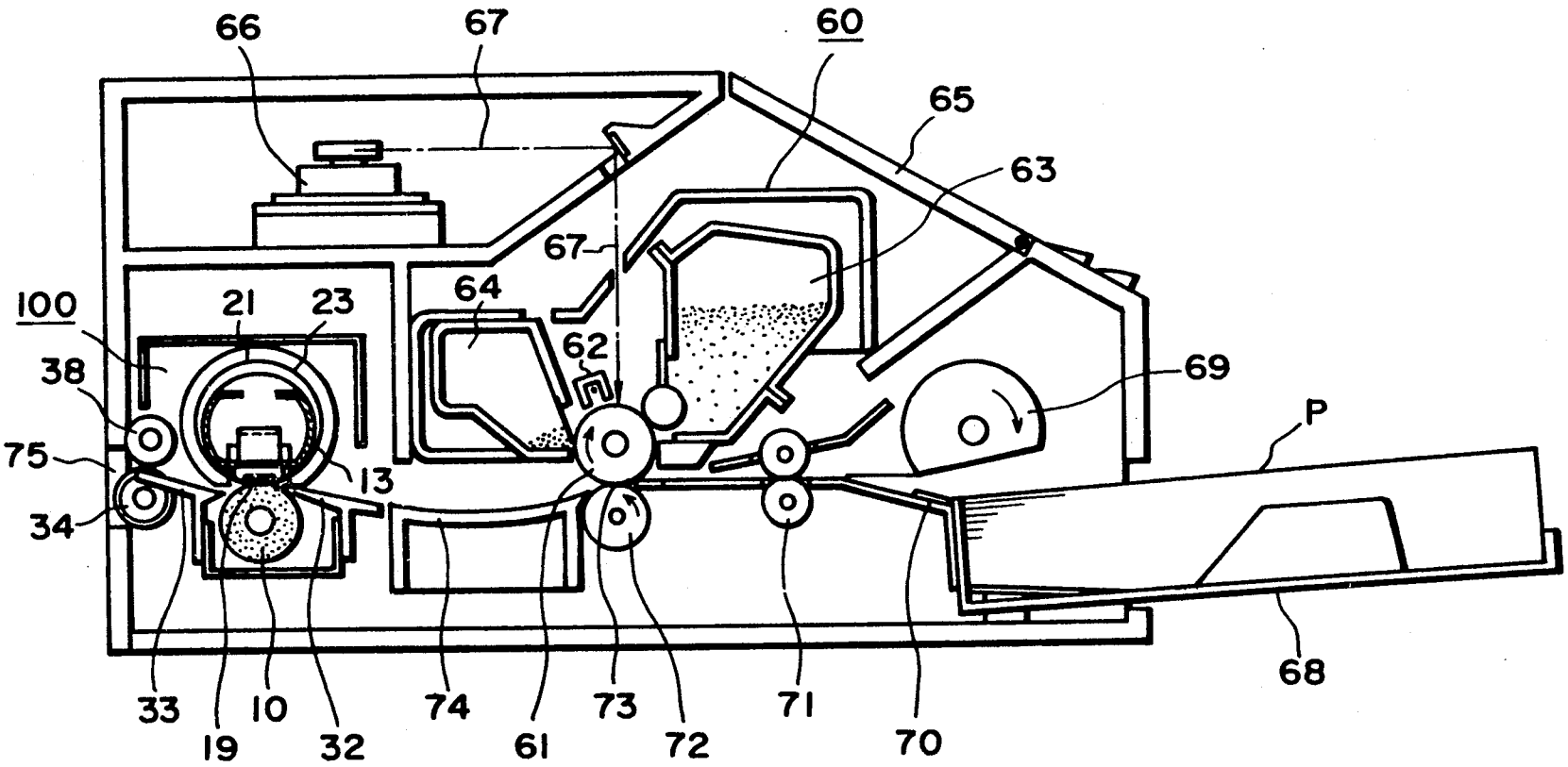
FIG. 8 is a sectional view of an image forming apparatus in which the heating apparatus according to an embodiment of the present invention is incorporated.
Figure 9:
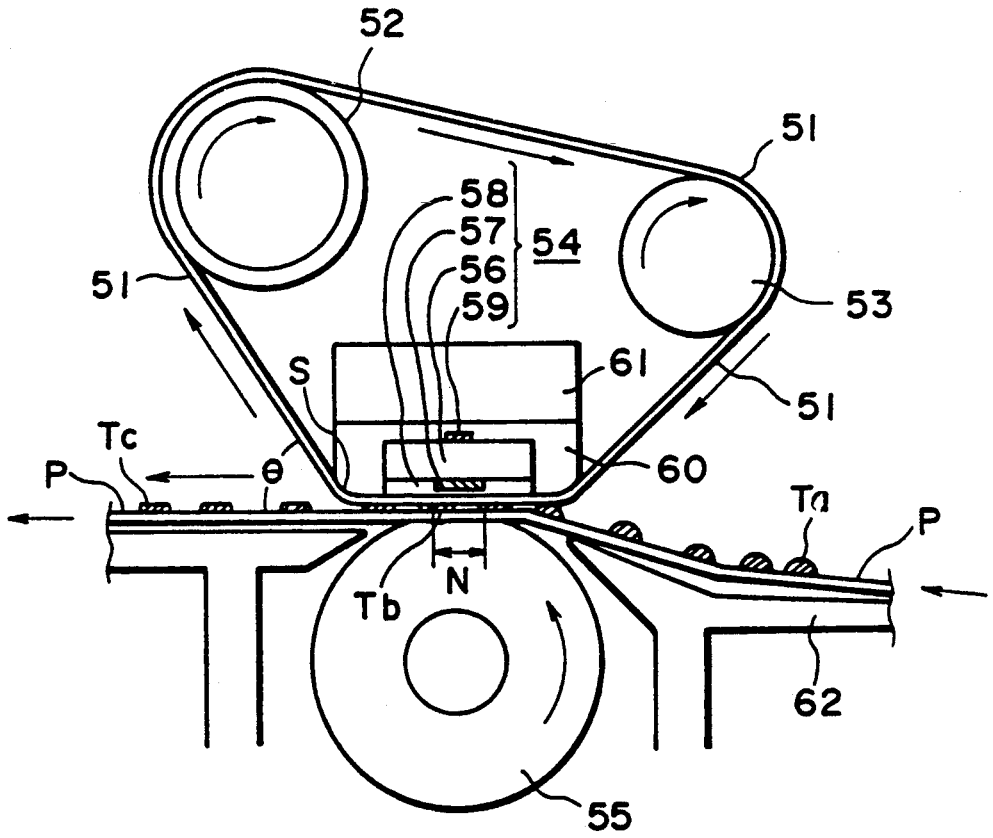
FIG. 9 PRIOR ART
FIG. 9 is a sectional view of an example of a film heating apparatus.

Referring to FIG. 8, there is shown an image forming apparatus in which the heating apparatus according to an embodiment of the present invention is used as a fixing device. The apparatus comprises a process cartridge 60 which includes four process means, i.e., an electrophotographic photosensitive member in the form of a rotatable drum 61 which will hereinafter be called "drum", a charger 62, a developing device 63 and a cleaning device 64. The process cartridge is detachably mountable to a predetermined position of the apparatus when an opening portion 65 of the apparatus is opened.

In response to an image formation start signal, the drum 61 is rotated in a direction indicated by an arrow, that is, in the clockwise direction in the Figure. The surface of the rotating drum 61 is uniformly charged to a predetermined potential of a predetermined polarity. The charged surface of the drum is exposed to a laser beam emitted from a laser scanner 66 and is modulated in accordance with a time series electric digital picture element signal indicative of image information. By the scanning exposure of the drum to the laser beam 67, an electrostatic latent image is sequentially formed in accordance with the image information on the drum 61 surface. The latent image is visualized into a toner image by the developing device 63.

On the other hand, the recording material sheet P in the sheet feeding cassette 68 is separated and supplied one by one by cooperation between the sheet feeding roller 69 and a separation pad 70. The sheet is supplied to an image transfer nip 73 between the drum 61 and the transfer roller 72 in synchronism with the rotation of the drum 61 by the registration rollers 71. In the transfer nip 73, the toner image is sequentially transferred from the drum 61 surface to the recording material sheet P.

The recording material sheet P having passed through the transfer position 73 is separated from the surface of the drum 61 and is conveyed into the fixing apparatus 100 along a guide 74.

In the fixing apparatus 100, the unfixed toner image is fixed on the recording material sheet by heat and pressure.

Figure 1:
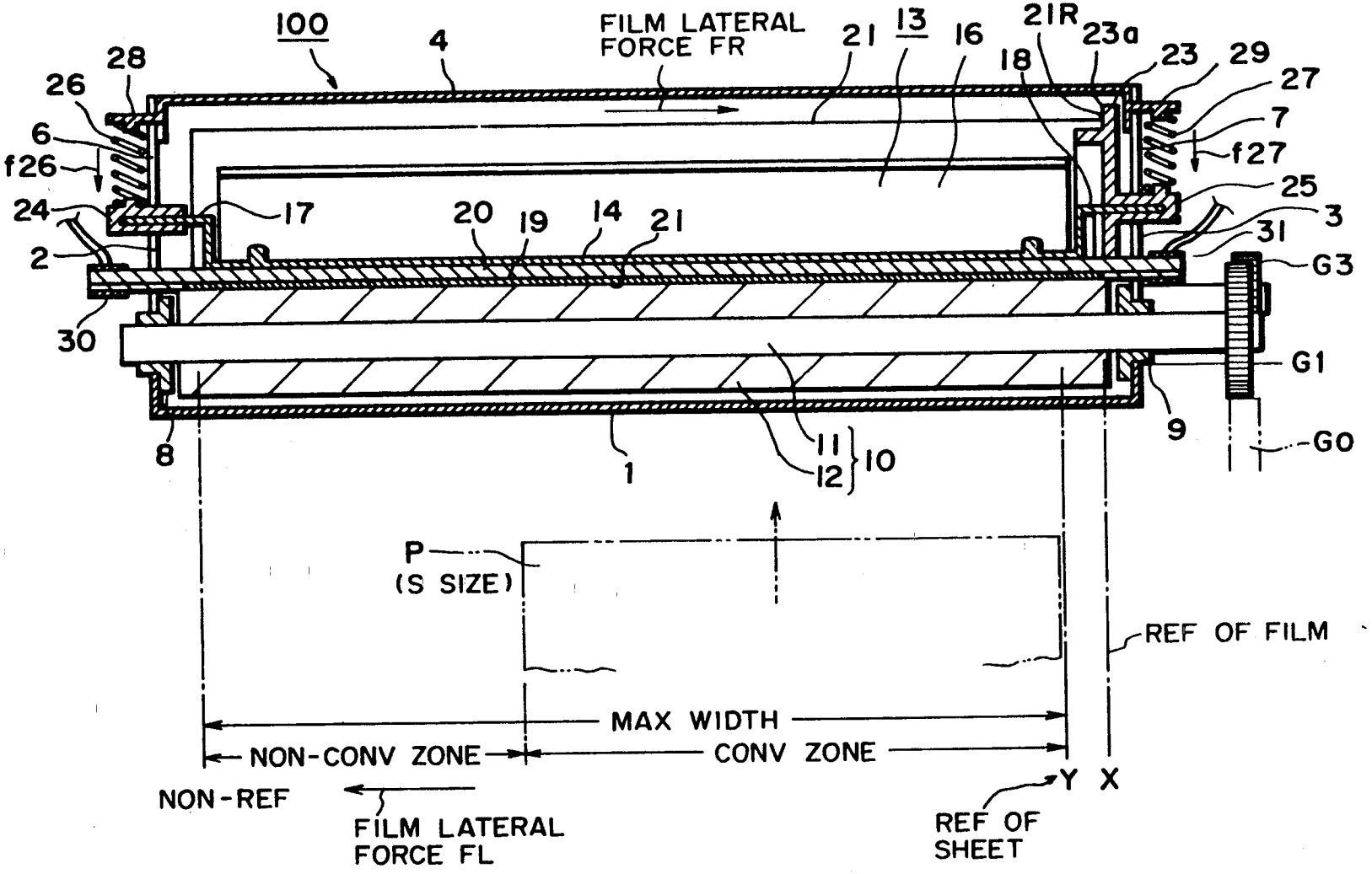
FIG. 1 is a longitudinal sectional view of a heating apparatus according to an embodiment of the present invention.
Figure 2:
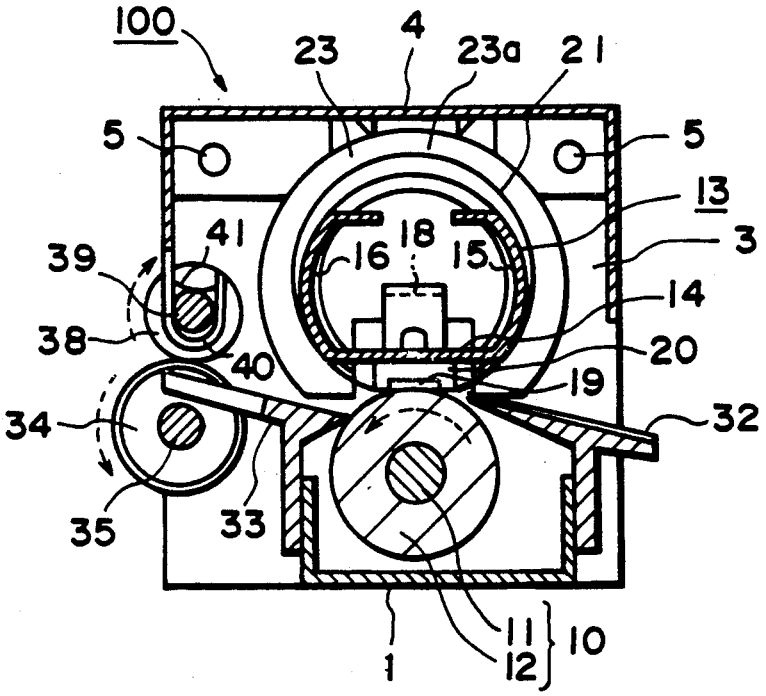
FIG. 2 is a cross-sectional view of an apparatus shown in FIG. 1.
Figure 3:
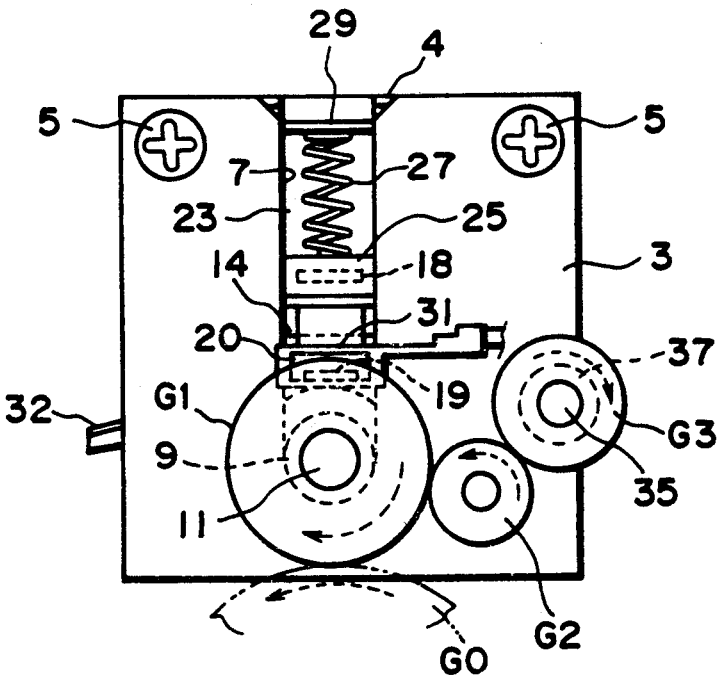
FIG. 3 is a right side view of an apparatus of FIG. 1.
Figure 4:
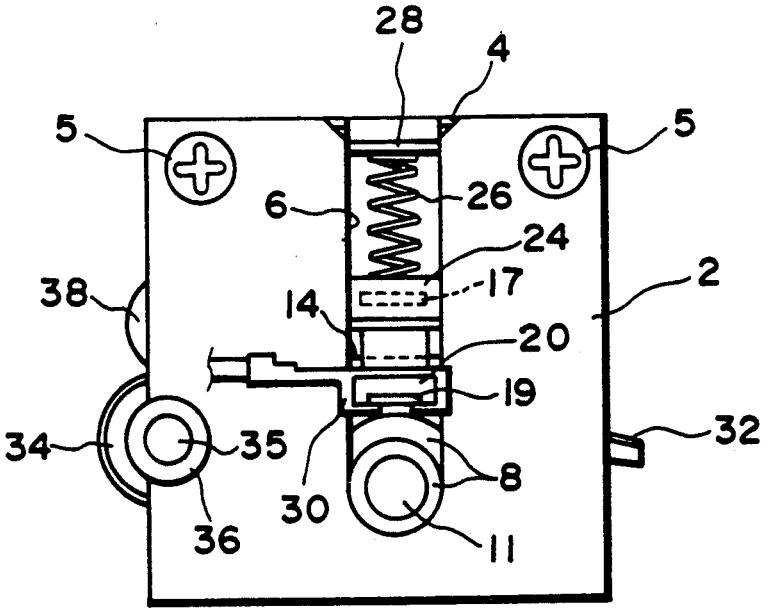
FIG. 4 is a left side view of the apparatus of FIG. 1.
Figure 5:
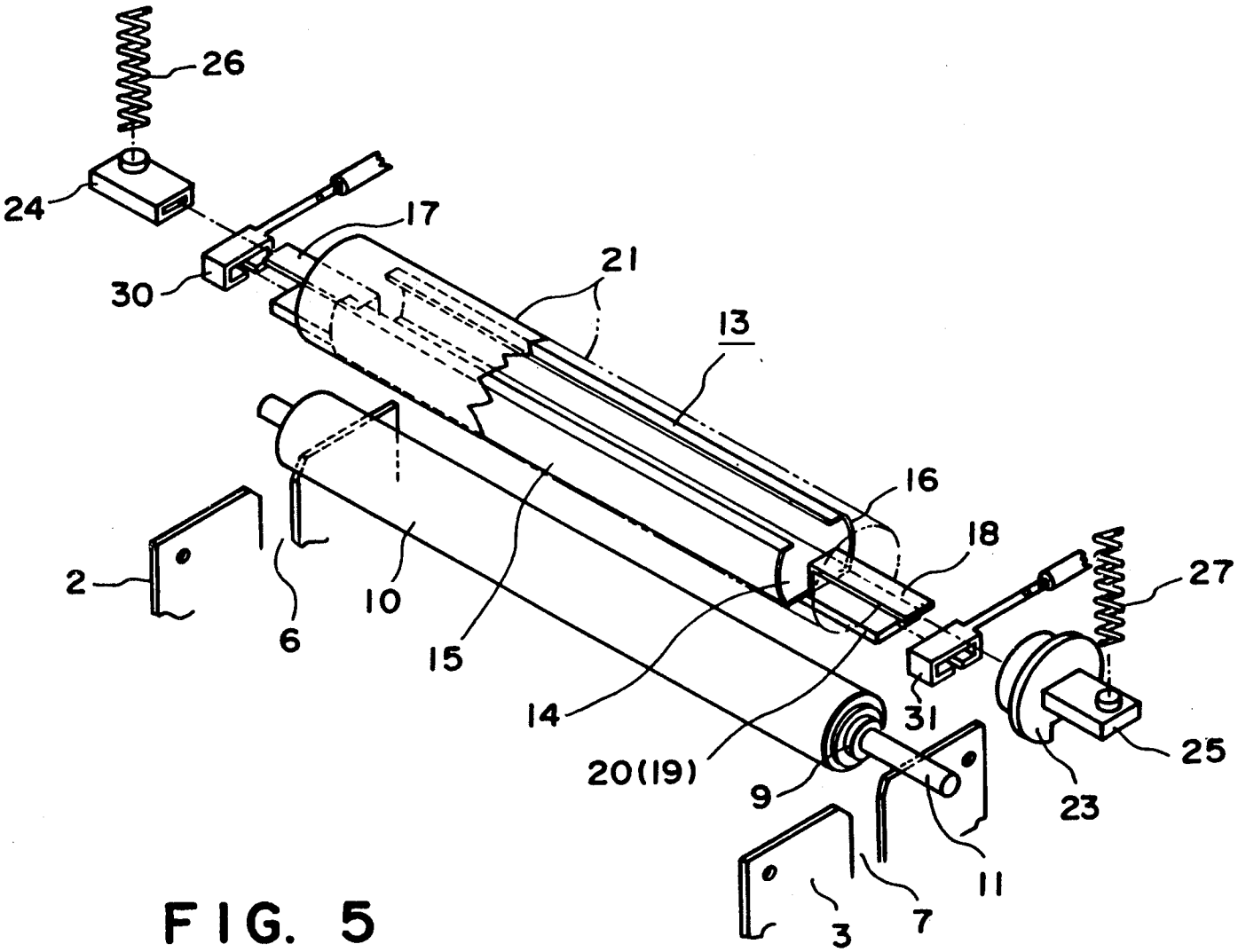
FIG. 5 is an exploded perspective view of a major part of the apparatus of FIG. 1.

Referring to FIGS. 1–7, there is shown a heat fixing apparatus 100 according to an embodiment of the present invention. FIG. 1 is a longitudinal front view of the apparatus 100; FIG. 2 is a cross-sectional view thereof; FIGS. 3 and 4 are right and left side views; and FIG. 5 is a perspective view of a major part thereof.

The apparatus comprises an elongated frame (bottom plate) in the form of a channel opening upwardly and left and right side plates 2 and 3 integral with the frame 1 at the left and right end of the frame 1, which is placed between the side plates 2 and 3 and fixed by screws 5. The top plate may be removed when the screws 5 are unthreaded.

Longitudinal openings 6 and 7 are formed substantially at the center of the left and right side plates 2 and 3 at symmetric positions. A pair of bearing members 8 and 9 are inserted to the bottom of the elongated openings 6 and 7. A back-up rotatable member in the form of a pressing roller 10 functions to form a nip N (FIGS. 6 and 7) in cooperation with the heater 19 with the film 21 therebetween. The pressing roller 10 receives driving force to rotate, and the film rotates following the rotation of the pressing roller. The film 21 is driven only by the rotation of the pressing roller 10 and does not receive any other rotational force. The pressing roller 10 comprises a central shaft 11 and a roller portion 12 made of rubber elastic material having good parting property such as silicone rubber or the like, on the outside of the shaft 11. The left and right ends of the central shaft 11 are rotatably supported by the bearing members 8 and 9. An elongated stay 13 made of plate functions as an inside guide for the fixing film 21 and also as supporting and reinforcing member for the heater 19 and the insulating member 20. The stay 13 comprises a bottom portion 14, outwardly arcuated front and rear plates 15 and 16 extended from the opposite ends of the bottom portion 14, and lags 17 and 18 extended horizontally toward the outside from the left and right ends of the bottom portion 14.

An elongated low thermal capacity linear heater 19 is mounted and supported on an elongated insulating member 20. The insulating member 20 is mounted to the bottom surface of the bottom portion 14 of the stay 13 in parallel therewith with the heater 19 facing down.

An endless heat resistive film 21 is extended around the outside of the stay 13 having the heater 19 and the insulating member 20. The internal circumferential length of the endless heat resistive film 21 is larger than the outer circumferential length of the stay 13 including the heater 19 and the insulating member 20, by 3 mm, for example, and therefore, the film 21 is loosely extended around the outer circumferential of the stay 13 including the heater 19 and the insulating member 20.

A limiting flange member 23 is mounted to the horizontal lag 18 at the right end of the stay 13 and functions to receive the end surface of the film 21 to prevent the lateral shifting of the film 21. A horizontal lag 25 is extended outwardly from the outer surface of the flange member 23, and the above-described outward horizontal lag 18 of the stay 13 is sufficiently inserted into the hole formed in the thickness of the lag 25 of the flange member 23 to securely support the flange member 23. In this embodiment, there is no flange member for limiting the film lateral end at the left side of the film 21, and a lag 24 functioning as mounting a spring is engaged with a left horizontal lag 17 of the stay 13.

When the apparatus is to be assembled, the film pressing roller 10 having the bearing members 8 and 9 is inserted into the longitudinal slots 6 and 7 of the side plates 2 and 3 without the top cover 4, so that the bearing members 8 and 9 are received by the bottom of the slots 6 and 7 (falling type).

On the other hand, the stay 13, the heater 19, the insulating member 20, the film 21, the right flange member 23 and the left lag 24 are assembled into a sub-assembly. The sub-assembly is then inserted into the elongated slots 6 and 7 of the side plates 2 and 3 from the top so that the outward projecting ends of the insulating member 20 and the left and right outward lags 24 and 25 are received by the slots 6 and 7, with the heater 19 facing down, until the heater 19 is received by the top surface of the pressing roller 10 which has been already received by the slots, with the film 21 interposed therebetween (falling type).

Coil springs 26 and 27 are placed on the lags 24 and 25 extended through the elongated slots 6 and 7 toward outside of the side plates 2 and 3 and are placed by the projections on the top surfaces of the lags. Lags 28 and 29 of the top cover 4 are aligned with the top ends of the coil springs 26 and 27, and the top cover 4 is inserted to a predetermined position while compressing the coil springs 26 and 27 between the lags 24 and 28 and 25 and 29, and the top plate is fixed between the side plates 2 and 3 by screws 5.

By doing so, the stay 13, the heater 19, the insulating member 20, the film 21, the right flange member 23 and the left lag 24 are urged downwardly by the action of the coil springs 26 and 27, so that the heater 19 and the pressing roller 10 are urged together with the film 21 therebetween at a total pressure of 4–7 kg.

Supply connectors 30 and 31 for supplying electric power to the heater 19 are mounted at the left and right ends of the insulating member 20 extending outwardly through the slots 6 and 7 outwardly from the side plates 2 and 3.

An inlet guide 32 for guiding the member to be heated is mounted on the front wall of the frame 1. In this example, the member to be heated is in the form of a recording material sheet P (FIG.7) carrying thereon a visualized image (powdery toner image) Ta. The recording material sheet is guided to the nip N (heating and fixing position) between the heater 19 and the pressing roller 10 with the film 21 therebetween, more particularly between the film 21 and the roller 10.

An outlet guide 33 is mounted on the rear surface of the frame 1, and it functions as a separation guide to guide the recording material sheet having passed through the nip into a nip between the bottom discharging roller 34 and a top pinch roller 38.

The shaft 35 of the discharging roller 34 is rotatably supported between the bearings 36 and 37 mounted on the side plates 2 and 3. A shaft 39 of the pinch roller 38 is received by a hook 40 provided by bending a part of a rear wall of the top cover 4 toward the inside, and the pinch roller 38 is contacted to the top surface of the discharging roller 34 by the weight thereof and a spring 41. The pinch roller 38 rotates following the rotation of the discharging roller 34.

A first gear G1 is fixedly mounted to the right end of the roller shaft 11 projected outwardly from the right side plate 3, and a third gear G3 is fixed to the right end of the shaft 35 of the discharging roller outwardly projected from the right side plate 3. Second gear G2 is a relaying gear rotatably mounted on the outside of the right side plate 3 and is engaged with the first gear G1 and the third gear G3.

The first gear G1 receives the driving force from a driving gear G0 of an unshown driving source, by which the pressing roller 10 is rotated in the counterclockwise direction in FIG. 2. In response thereto, the rotational force of the first gear is transmitted to the third gear G3 through the second gear G2, so that the discharging roller 34 is rotated in the counterclockwise direction in FIG. 2.

Figure 6:
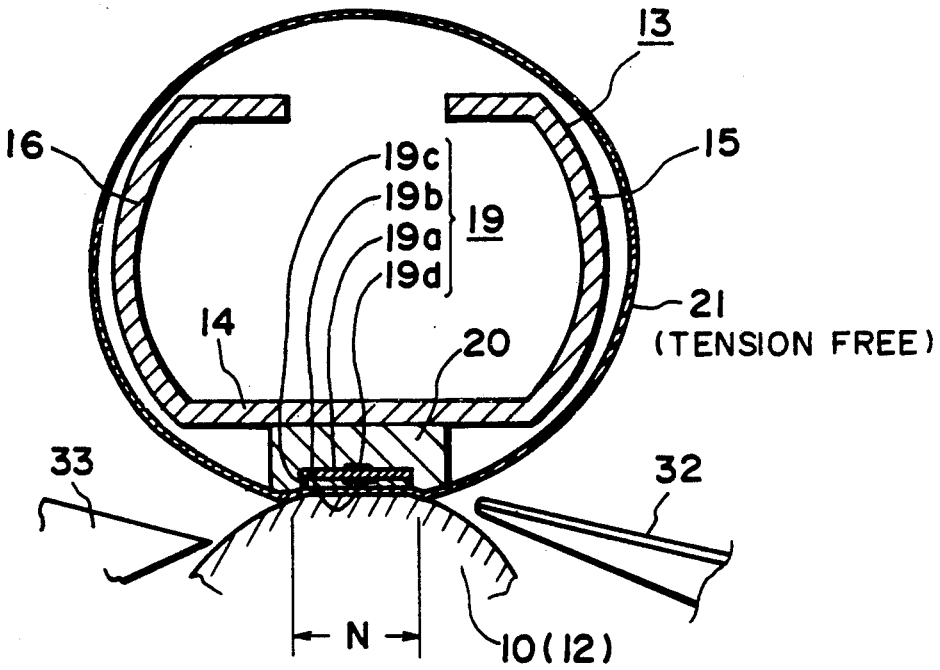
FIG. 6 is an enlarged sectional view of a major part of the apparatus of FIG. 1 where the film is not driven.

The operation of the heat fixing apparatus of this embodiment will be described. In this embodiment, the endless heat resistive film 21 during non-operation, is tension-free (with substantially no tension) at substantially all of its circumferential area except for the portion disposed in the nip N between the heater 19 and the pressing roller 10, as shown in FIG. 6 which is an enlarged view of a major part of the fixing apparatus.

Figure 7:
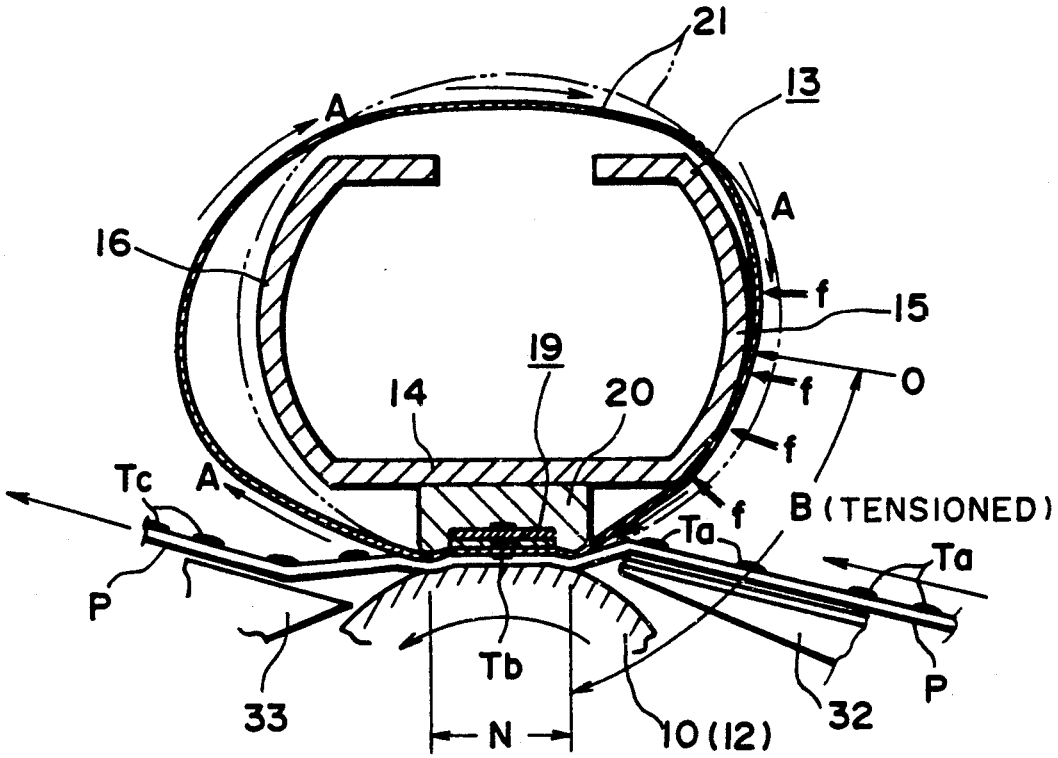
FIG. 7 is an enlarged cross-sectional view of the apparatus of FIG. 1 when the film is driven.

When the pressing roller 10 is rotated in the counterclockwise direction in FIG. 7 at a predetermined peripheral speed by the driving force transmitted to the first gear G1 from the driving gear G0 of the driving source, the film 21 is moved by the friction with the rotating pressing roller 10 in the nip N, and it is moved in the clockwise direction A at substantially the same peripheral speed of the pressing roller 10 while the inside surface of the film is in sliding contact with the surface of the heater 19.

When the film 21 is driven, the pulling force f is applied to the part of the film which is upstream of the nip N with respect to the rotational direction of the film, by which the film 21 rotates while it is in sliding contact with that part of the inside of the film guide that is upstream of the nip with respect to the rotational direction of the film, as indicated by solid line in FIG. 7, that is, substantially the bottom half portion of the outward arcuated front plate 15 of the stay 13. Thus, when the film 21 rotates, the tension force is applied in the part of the film B which is between the contact starting point O between the film 21 and the front plate 15 and the downstream nip N, by which at least such a part of the film, that is, the part B adjacent the recording sheet inlet side of the nip N, is prevented from creasing by the application of the tension force. When the film is driven with the electric power supplied to the heater 19, the sheet P carrying the unfixed toner image Ta is guided by the inlet guide 32 and is introduced into the nip N between the rotating film 21 and the pressing roller 10. The recording sheet carries the image on its top surface. Then, the recording sheet P is closely contacted to the surface of the film and is passed through the nip N together with the film 21. During the passage therethrough, the thermal energy from the heater 19 contacted to the inside of the film in the nip N is applied to the recording sheet P through the film, by which the toner image Ta is fused or softened into a fused or softened image Tb.

The recording sheet P having passed through the nip N is separated from the film 21 surface when the toner temperature is still higher than the glass transition point, and is guided to between the discharging roller 34 and the pinch roller 38 along the outlet guide 33, so that it is discharged to outside the apparatus. During the period between the discharge from the nip N to the arrival at the discharging roller 34, the softened or fused toner image Tb on the recording sheet P is cooled and solidified into a solidified image Tc.

In the foregoing, the recording sheet P introduced into the nip N is moved together with the film 21 through the nip N while always in close contact with the portion of the film which is stretched and therefore which is free from the crease. Accordingly, the non-uniform heating, non-uniform image fixing or the stripe is not produced in the fixed image, which may otherwise be caused.

The film 21 receives the tension only at a part of its circumference, that is, it receives the tension only at the nip N and the part B, irrespective of whether it is driven or not driven. More particularly, when it is not driven (FIG. 6), the film 21 is tension free at almost all circumferential portions except for the nip N. When it is driven (FIG. 7), it is tension free at almost all of the circumferential portions except the nip N and the portion B adjacent the recording material inlet of the nip N. In addition, the total circumferential length may be short. For these reasons, the driving torque required for driving the film is small, and the structure of the film, the constituent parts and the driving system are simplified, and the size and the cost thereof are reduced.

The film 21 receives tension force only at a part thereof irrespective of whether it is driven or not driven, the lateral shifting force is small even if the film tends to laterally shift when it is driven.

The description will now be made as to the relation between the lateral shift limitation of the film 21 and the index or reference for the recording material. In this embodiment, the pressures provided by the coil springs 26 and 27 between the heater 19 and the pressing roller 10 are set such that the pressure f27 by the right spring 27 which is close to the driving side for the pressing roller 10 where the first gear G1 is mounted, is larger than the pressure f26 of the left spring 26 at the non-driven side of the pressing roller 10 (which is left side opposite from the right side where the first gear G1 is mounted).

Therefore, the pressure is maintained balanced even if the reaction force is produced by the drive transmission by the gear in the driving operation. Moreover, in this embodiment, the total pressure f27 is larger than the total pressure f26 by not less than 200 g. Therefore, when the sheet is not passed through the nip while the film 21 is driven, the film 21 receives a lateral shifting force FR (FIG. 1) toward the right side along the length of the stay 23. The driving side to which the lateral force acts is the recording material conveyance reference side. The difference between the pressure f27 and f26 is preferably not more than 1.5 kg. If it is larger than 1.5 kg, the lateral shifting force is too large.

Only the lateral shifting side 21R of the film 21 is received by and limited by a regulating surface **23*a* of the right flange member 23 functioning as the regulating member, so that the film lateral shift control is made stable and easy. In FIG. 1, X indicates the reference line of the film which corresponds to the regulating surface 23*a* of the right flange 23**, and Y indicates the recording sheet conveyance reference line, wherein the line Y is at the same side as the reference line X. The recording material P is conveyed with its right side aligned with the reference line Y.

When a small size recording material is passed through the nip, the lateral shifting force FR toward the limiting reference side of the film 21 reduces because the area away from the end reference surface X is absent from the recording material. For this reason, the abutting force to the regulating surface **23*a* of the flange member 23** at the film abutting side, reduces. Therefore, the lateral end damage of the film can be prevented, and therefore, the durability of the film is increased.

When a very small size recording material such as envelope or post card is passed through the nip, the lateral force FL to the non-reference side is produced, by properly setting the pressures. By doing so, during the recording material conveyance, the lateral end 21R of the film is spaced apart from the reference surface **23*a***, and when the conveyance of the recording material is completed, it is abutted to the reference surface. This is a possible alternative.

According to this embodiment, only one lateral shift limiting member, that is, one flange member 23 is required, and therefore, the number of parts and the size of the apparatus can be reduced.

As for the means for limiting the lateral shift of the film, another member other than the flange member is usable. For example, a rib or ribs of heat resistive resin along the circumference of the film may be provided at the lateral end of the film. Because of the reduction of the film lateral force, the rigidity of the film can be lowered, and therefore, the thickness of the film can be reduced with the result that the thermal capacity thereof is reduced. This further improves the quick start nature of the apparatus.

The description will be made in detail as to the film 21 used in this embodiment. From the standpoint of improving the quick starting nature by reducing the thermal capacity of the film 21, the total thickness of the film is preferably not more than 100 microns, preferably not more than 40 microns and not less than 20 microns. It is a single layer or multi-layer film exhibiting high thermal resistivity, parting property, mechanical strength and durability or the like.

It may be of polyimide, polyether imide, (PIE), polyether sulfone (PES), tetrafluoroethylene perfluoroalkyl vinyl ether copolymer resin (PFA), polyether ether ketone (PEEK), or polyparabanic acid (PPA). It may be in the form of a multi-layer film comprising, for example, a polyimide film having a thickness of 20 microns and a parting layer having a thickness of 10 microns of fluorinated resin such as PTFE (tetrafluoroethylene resin), PAF, FEP, silicone resin or the like or any of them added with conductive material such as carbon black, graphite or conductive whisker, at least on the image contacting side of the polyimide film.

Now, the description will be made as to the heater 19 and the insulating member 20.

As shown in FIG. 6, the heater 19 comprises the heater base 19*a*, the heat generating resistor (heat generating element) 19*b*, the surface protection layer 19*c* and the temperature detecting element 19*d*.

The heater base 19*a* is a high heat resistivity, heat insulating, low thermal capacity and high thermal conductivity material. As an example, it is an alumina plate having a thickness of 1 mm, a width of 10 mm and a length of 240 mm.

The heat generating element 19*b* is applied by screen printing or the like in the form of a line or stripe having a width of 1-3 mm and a thickness of approximately 10 microns along the length of the bottom surface (the film 21 side) of the heater base 19*a* substantially at the center thereof. It is of an electric resistance material such as Ag/Pd (silver palladium), $Ta_2N$, $RuO_2$ or the like. The surface thereof is coated with a heat resistive glass having a thickness of 10 microns as the surface protection layer 19*c*.

The temperature detecting element 19*d*, for example, is a temperature detecting resistor material having a low thermal capacity such as Pt film or the like printed by screen printing or the like on the top surface of the heater base 19*a* (the surface opposite from the surface having the heat generating element 19*b*) substantially at the center thereof. It may be in the form of a low thermal capacity thermister.

In this embodiment, the heater 19 is supplied with power at a predetermined timing from the image formation start signal to the heat generating element 19*b* in the form of a line or stripe, so that the heat is generated substantially over the entire area of the heater 19*b*.

The power source is AC 100 V, and in accordance with the temperature detected by the temperature detecting element 19*d*, a phase angle of the power supply is controlled by a power supply control circuit (not shown) including triac, thus controlling the power supply thereto. Since the thermal capacities of the heater base 19*a*, the heat generating element 19*b* and the surface protection layer 19*c* are small, and therefore, in response to the power supply to the heat generating element 19*b*, the surface of the heater 19 quickly increases to a predetermined fixing temperature (140°-200° C., for example).

The heat resistive film 21 contacted to the heater 19 also has a low thermal capacity, and therefore, the thermal energy from the heater 19 is efficiently transferred through the film 21 to the recording sheet P press-contacted to the film, and therefore, the image is efficiently heated and fixed.

The surface temperature of the film contacted to the heater 19 is quickly heated up to a sufficiently high temperature (the fixable temperature for the recording sheet P), and therefore, the quick starting nature is accomplished. This eliminates the necessity for the standby temperature control in which the heater 19 is heated beforehand, and therefore, the energy can be saved, and the inside temperature rise of the apparatus can be prevented.

The heat insulating member 20 functions to thermally isolate the heater 19 to efficiently use the generated heat and is made of highly heat insulative and highly heat resistive material such as PPS (polyphenylene sulfide), PAI (polyamide imide), PI (polyimide), PEEK (polyether ether ketone), liquid crystal polymer or the like.

Figure 10:
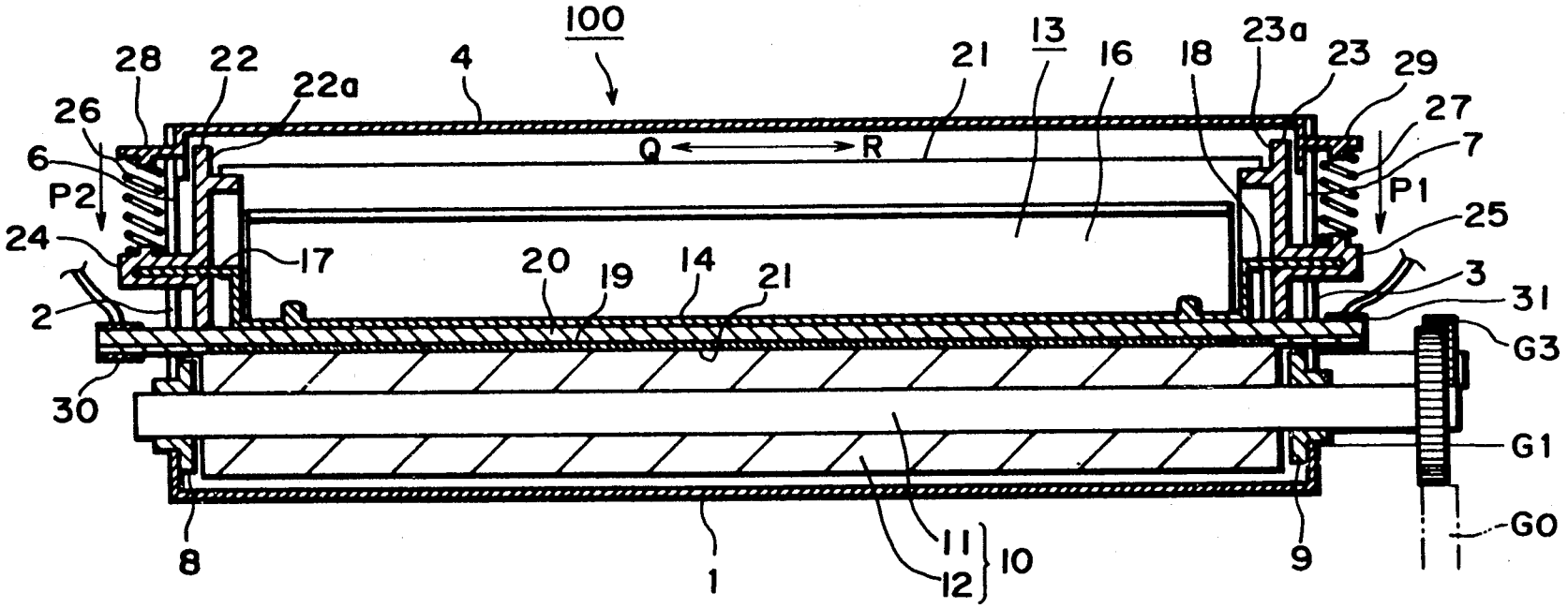
FIG. 10 is a longitudinal sectional view of a heating apparatus according to another embodiment of the present invention.
Figure 11:
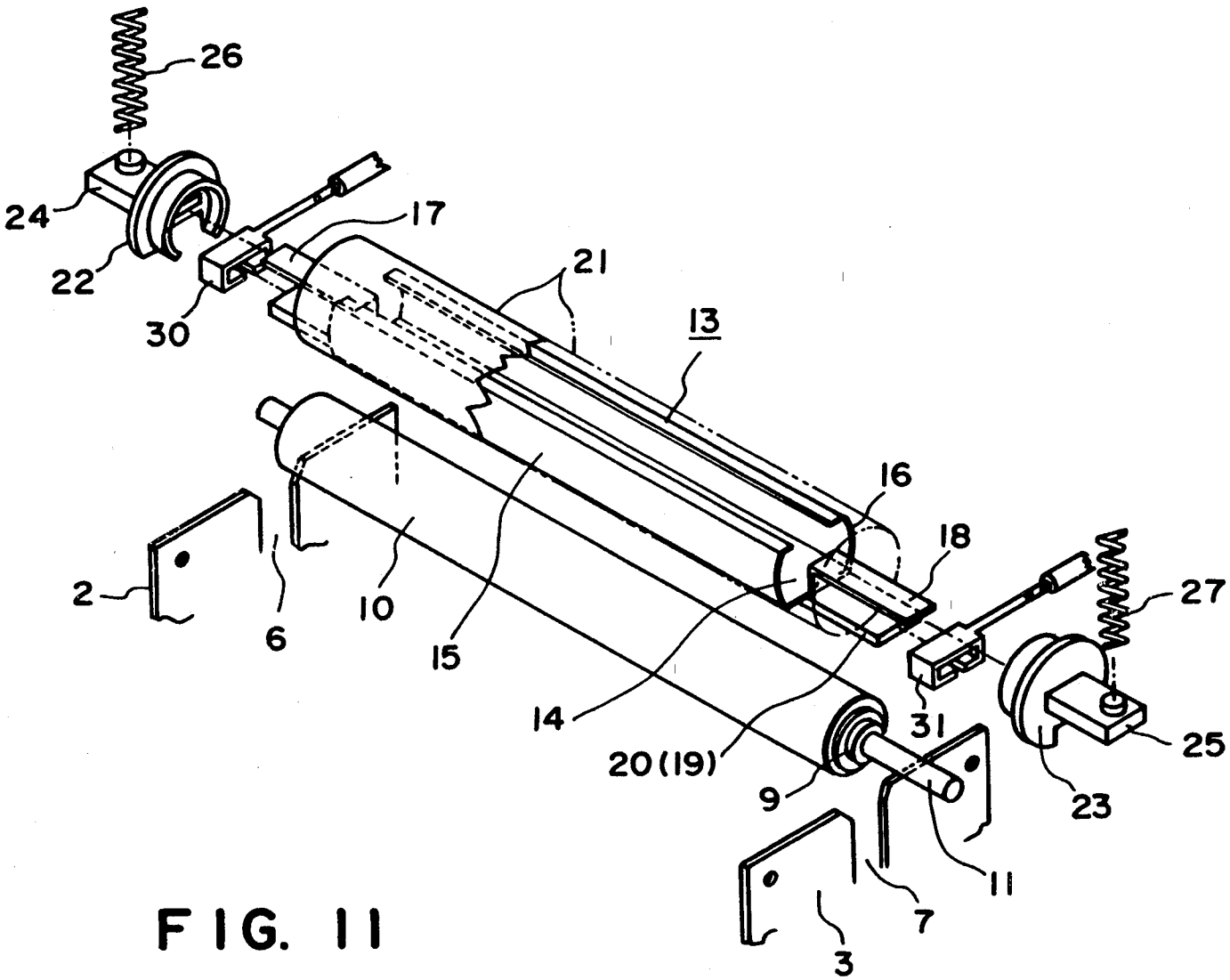
FIG. 11 is an exploded perspective view of a major part of the apparatus of FIG. 10.

Referring to FIGS. 10 and 11, a further embodiment of the present invention will be described. FIG. 10 is a longitudinal sectional view, and FIG. 11 is an exploded perspective view of a major part of the apparatus of this embodiment. In this embodiment in order to prevent reduction of the pressure at the driven side due to the reaction produced during the gear drive, the pressure P1 at the driving side is made larger than the pressure P2 at the non-driven side. The pressures are so selected that the driven side pressure and the non-driven side pressure are balanced during the drive of the film. In this embodiment, the film lateral shift limiting members are provided at both of the lateral ends of the film. Therefore, the difference in the pressures at the opposite ends of the film during the film drive can be further reduced. This embodiment is particularly effective when the recording material is conveyed with its center aligned with the center of the film.

Figure 12:
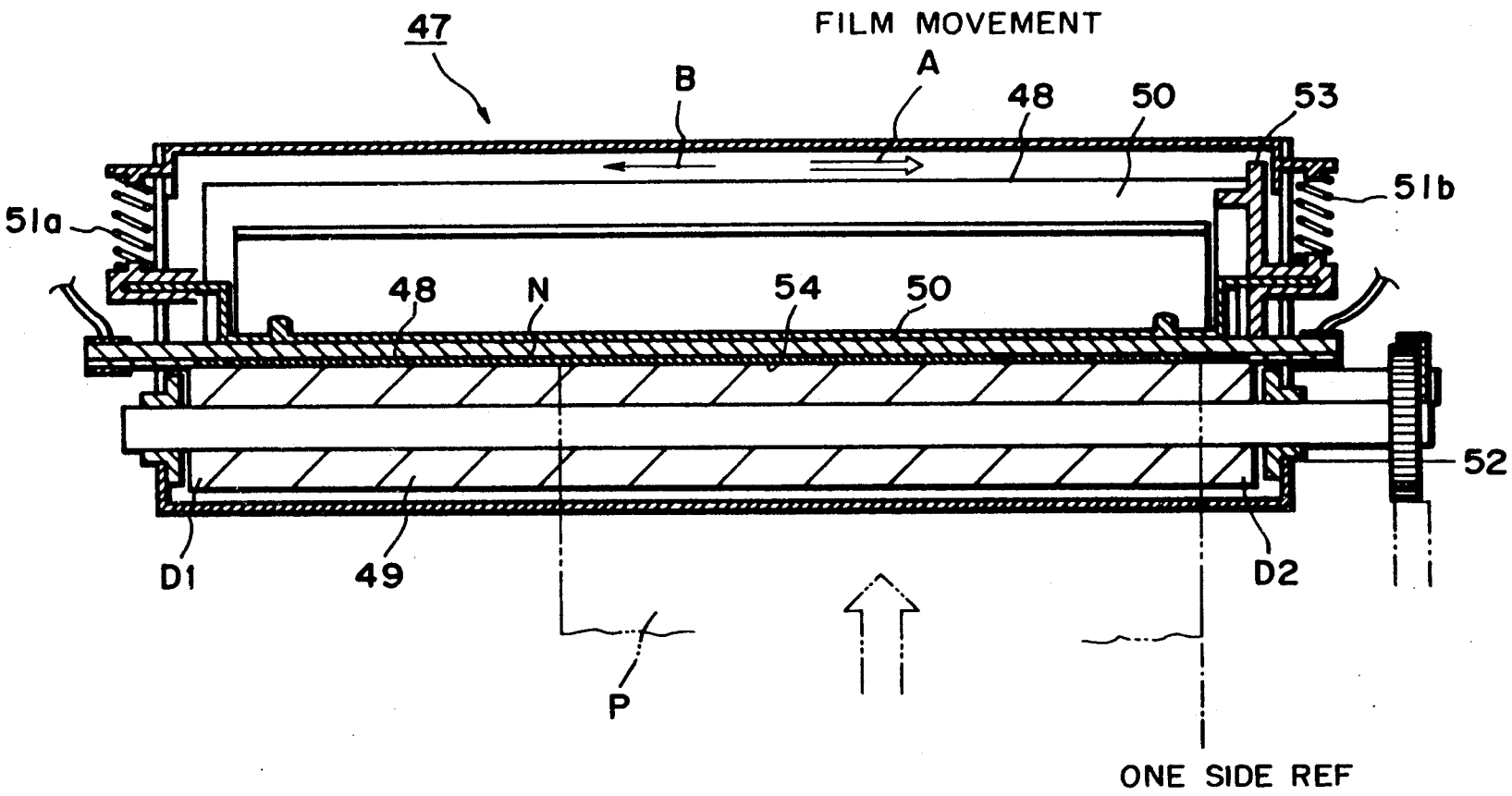
FIG. 12 is a longitudinal sectional view of a heating apparatus according to a yet further embodiment of the present invention.
Figure 13:
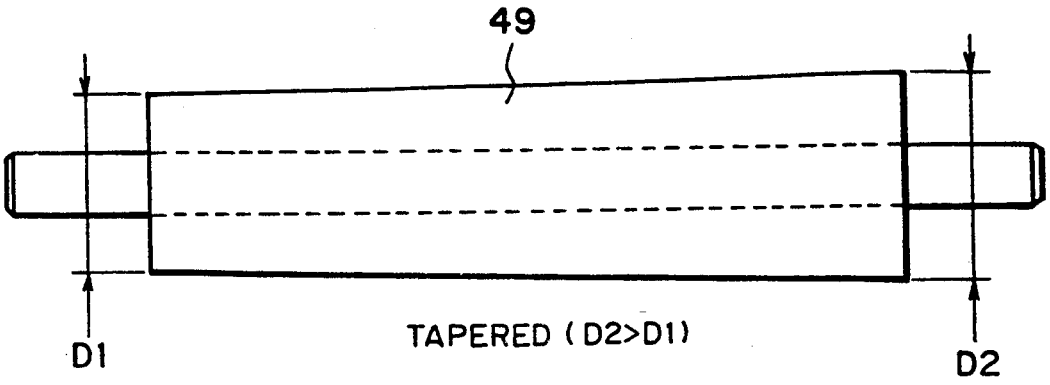
FIG. 13 is a front view of a pressing roller used in the apparatus of FIG. 12.

Referring to FIGS. 12 and 13, the description will be made as to a further embodiment. In this embodiment, the lateral shifting direction of the endless film is limited to one direction, as in the above-described first embodiment. In addition, the recording material is conveyed with its one lateral end aligned with a conveyance reference of the film adjacent a lateral end of the film. The lateral shifting direction of the film is limited toward the conveyance reference side. FIGS. 12 and 13 are a longitudinal sectional view of the fixing apparatus 47 and a front view of a pressing roller 49.

The fixing film 48 is in the form of a single layer fixing film having a high thermal durability, toner parting property and mechanical strength or in the form of a multi-layer film having a treated surface or lamination. For example, it is a single layer film having a thickness of approximately 50 microns made of polyester (PET) or polyimide (PI) or the like treated for heat resistivity, or a multi-layer film having a parting layer of tetrafluoroethylene (PTFE) resin on the above film.

In the fixing apparatus 47 of this embodiment, the fixing film 48 is an endless cylindrical form, which is free from tension except for the portion in the nip N in the circumferential region, and it is moved only by the friction with the pressing roller 49.

The pressing roller 49 is tapered. The heater 54 contacted to the film guide 50 for guiding the inside surface of the fixing film 48 over the entire longitudinal area, and the pressing roller 49, are press-contacted to each other at total pressure of 3–6 kg (A4 size width) by pressure springs 51*a* and 51*b* with the fixing film 48 therebetween.

On the surface of the heater 54 is a linear or stripe thin heat generating resistor made of $TaSiO_2$, silver-palladium ($Ta_2N$), $RuO_2$, nickel chrome or the like, applied by evaporation, sputtering, CVD, screen printing or the like.

At the large diameter side D2 of the tapered pressing roller 49, there is a flange 53 mounted to the fixing film guide 50 during the assembling. It is effective to limit the lateral shift of the fixing film 48 during operation of the fixing device 47 by abutting the fixing film 48 end.

The recording material P having the unfixed toner image is introduced into the fixing nip N together with the fixing film 48 by the surface friction of the pressing roller 49 driven by the driving gear 52, and thereafter, at least in the fixing nip N, it is advanced at the same peripheral speed as the fixing film 48 and the pressing roller 49 without slippage because of the pressure applied by the springs 51*a* and 51*b*.

While the pressure is applied during passage through the nip N, the heat is transferred onto the recording material P through the fixing film 48 from the heater 54, so that the unfixed toner image on the recording material P is softened or fused.

After passing through the fixing nip N, the fixing film 48 and the recording material P continues to be conveyed while they are kept closely contacted to each other by the adhesive force of the toner fused or softened. During this conveyance, the heat is emitted from the fused or softened toner, and the toner is cooled and solidified, so that a permanent fixed image is formed on the recording material P.

After this cooling step, the recording material P is easily separated from the fixing film 48 since the toner is cooled and solidified. Then, the recording material P is discharged from the fixing device 47.

The pressing roller 49 which functions to press-contact the inside surface of the fixing film 48 to the heater 54 and also functions to move the fixing film 48, is tapered so that the circumferential length thereof increases from one end to the opposite end. Therefore, the fixing nip width is not uniform with the result of difference in the fixing film 48 moving force. Therefore, the fixing film 48 receives the lateral shifting force only in a direction to a large diameter side D2 of the pressing roller 49, that is, the direction A (FIG. 12). Even if the recording material P is conveyed with its lateral end aligned with a lateral conveyance reference, the lateral shifting force of the fixing film 48 toward the sheet absent side (B) is made not more than the lateral shifting force A by the paper configuration of the pressing roller 49 if the recording material P is conveyed with its lateral end aligned with the conveyance reference at the large diameter side D2. Thus, the lateral shifting force direction is limited to one direction irrespective of the conveyance reference for the recording material P.

Figure 14:
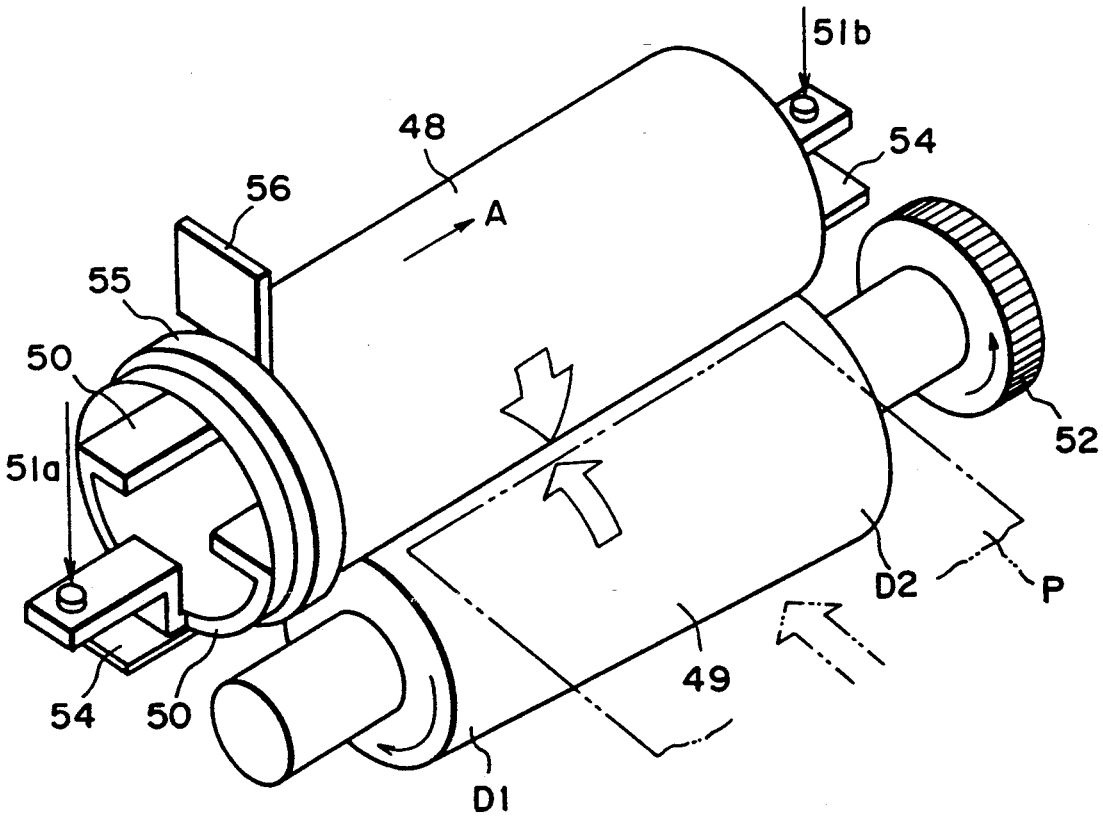
FIGS. 14 and 15 are perspective views of major parts of the apparatuses according to further embodiments of the present invention.

Referring to FIG. 14, a yet further embodiment will be described. In the endless fixing film 48, there are disposed a guiding member 50 for guiding movement of the fixing film and the heater 54. The fixing film 48 is sandwiched between a tapered pressing roller 49 and the heater 54, and is advanced by the surface friction with the pressure roller 49 driven by a driving gear 52. The lateral shifting force direction of the fixing film 48 produced during the movement thereof, is toward the large diameter side D2 of the pressing roller 49 (direction A). The lateral shift is controlled by the rib 55 of heat resistive resin which is fixed on an outer periphery of the fixing film 48 at a side opposite from the lateral shifting direction A and which is limited by rib limiting plate 56, the rib 55 having a uniform width and height.

The materials and structures of the fixing film 48 and the guide 50 are the same as in the previous embodiment. The pressing roller 49 has the same tapered configuration as in the previous embodiment. In this embodiment, the lateral shifting direction of the fixing film 48 can be limited only by the tapered configuration of the pressing roller 49 irrespective of the conveyance reference. Therefore, the rib limiting plate 59 is provided only at the lateral shifting direction of the fixing film 48, and therefore, the simplified lateral shift control is possible.

Figure 15:
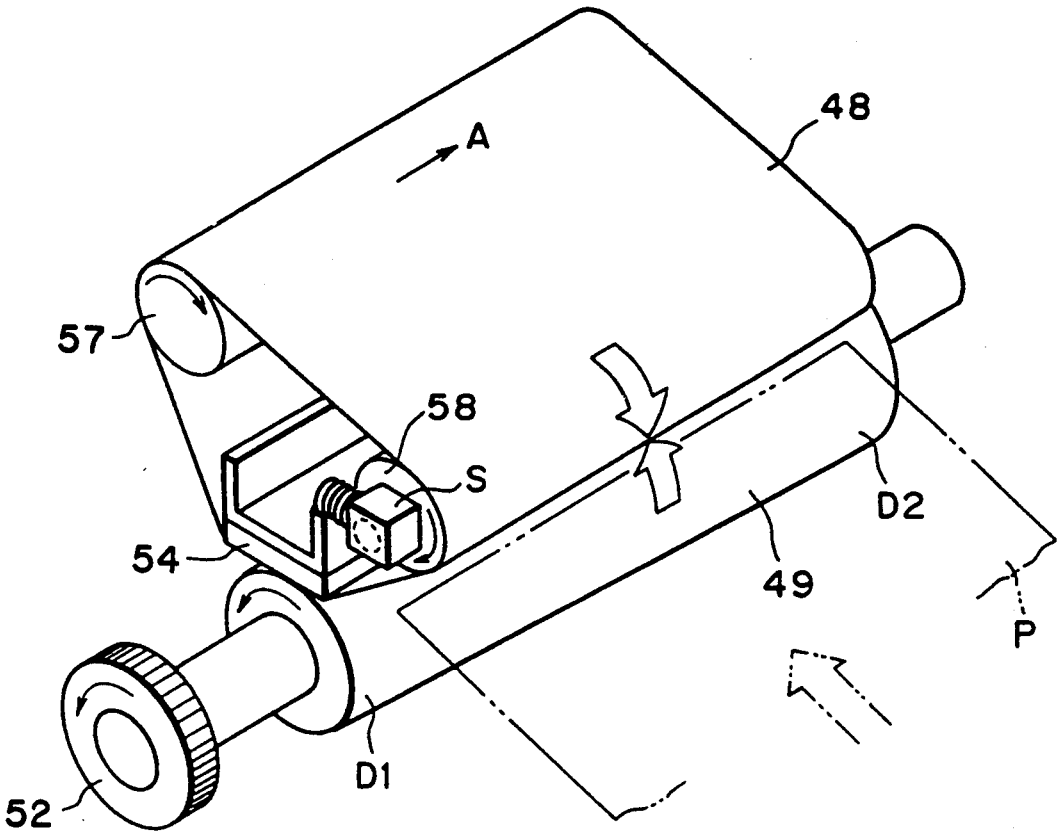

FIG. 15 is a perspective view of a major part of an apparatus according to a further embodiment of the present invention. In the fixing film 48, there are a film conveying roller 57, a tension roller 58 and a heater 54, and the fixing film 48 is stretched around the members 57, 58 and 54. The pressing roller 49 functioning as the pressing member is also tapered, and moves the fixing film 48 by the friction with an outer surface of the fixing film 48 when the pressing roller 49 is driven by the driving gear 52, while the pressing roller 49 is being urged to the heater 54 with the fixing film 48 therebetween. The lateral shifting direction A of the moving fixing fil·n can be controlled by the tapered configuration of the pressing roller 9 irrespective of the conveyance reference for the recording material P, similarly to the foregoing embodiments. Therefore, the lateral shift control is possible only by vertically moving the shaft of the tension roller 58 at the lateral shifting side A at predetermined timing, and therefore, the lateral shift control is simplified. Designated by a reference S is a solenoid and the like for vertically moving the shaft of the tension roller 58.

The film 48 has been described as being an endless belt. However, this is not limiting, and a non-endless film may be rolled and gradually supplied.

Figure 16:
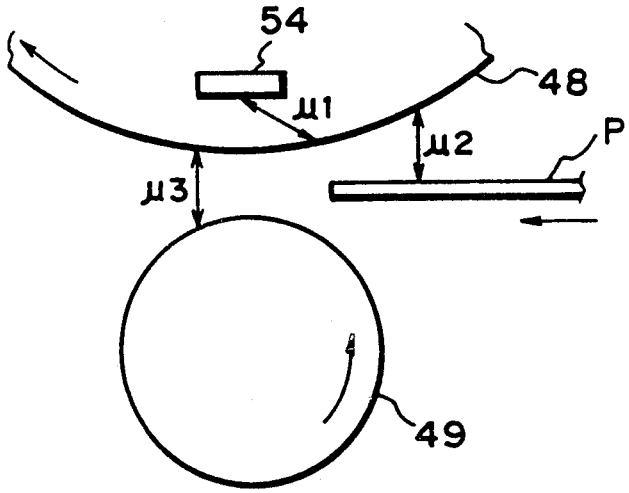
FIG. 16 shows a relation between frictional coefficients between major members.

FIG. 16 shows a relation of the frictional coefficients between the members. The frictional coefficient $\mu 1$ between the heater 54 and the inside surface of the film 48, a frictional coefficient $\mu 2$ between the outer peripheral surface of the film 48 and the recording material P, and a frictional coefficient $\mu 3$ between the outer peripheral surface of the film 48 and the pressing roller 49, satisfy:

$$\mu 1 < \mu 2 < \mu 3.$$

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus, comprising:

a heater;

an endless film;

a back-up member cooperative with said endless film to form a nip therebetween, wherein a recording material is conveyed with its lateral end aligned with a conveyance reference and has an image thereon, which is heated by heat from said heater;

wherein a lateral shifting force of said endless film when the recording material is not passed through the nip is directed always toward the conveyance reference.

2. An apparatus according to claim 1, further comprising a limiting member for limiting a lateral end of said film adjacent the conveyance reference.

3. An apparatus according to claim 2, wherein said limiting member limits a lateral edge of said film.

4. An apparatus according to claim 1, wherein said apparatus is capable of heating images of recording materials having different sizes.

5. An apparatus according to claim 4, wherein said apparatus is capable of heating an envelope.

6. An apparatus according to claim 4, wherein the lateral shifting force of said film when a small size recording material is passed through the nip is smaller than the lateral shifting force when no sheet is passed through the nip.

7. An apparatus according to claim 4, wherein a direction of said film lateral shifting force when a small size recording material is passed through the nip is opposite from the direction of said film lateral shifting force.

8. An apparatus according to claim 1, wherein said heater is stationary in use, and said film is in slidable contact with said heater.

9. An apparatus according to claim 1, wherein said apparatus heats and fixes an unfixed image on the recording material.

10. A heating apparatus, comprising:

a heater;

an endless film;

a back-up rotatable member urged to said heater with said endless film therebetween;

driving means for driving said back-up rotatable member at one end of said back-up rotatable member;

wherein pressure between said heater and said back-up rotatable member when said back-up rotatable member is not driven is larger at said one side of said back-up rotatable member than at the opposite side where said back-up rotatable member is not driven.

11. An apparatus according to claim 10, wherein a difference between the pressures at said one side at said opposite side is less than 1.5 kg.

12. An apparatus according to claim 10, wherein said film is rotated by said back-up rotatable member.

13. An apparatus according to claim 10, wherein said back-up rotatable member has a gear at said one end, and said driving means includes a transmission gear engaged with said gear of said back-up rotatable member.

14. An apparatus according to claim 10, wherein said recording material is conveyed with its lateral end aligned with a conveyance reference which is adjacent said one end.

15. An apparatus according to claim 10, further comprising a limiting member for limiting a lateral end of said film adjacent the conveyance reference.

16. An apparatus according to claim 15, wherein said limiting member limits a lateral edge of said film.

17. An apparatus according to claim 15, wherein said limiting member is provided at each side of said film.

18. An apparatus according to claim 10, wherein said heater is stationary in use, and said film is in slidable contact with said heater.

19. An apparatus according to claim 10, wherein the recording material carries an unfixed toner image which is fixed by heat and pressure applied in the nip formed between said film and said back-up rotatable member.

20. A heating apparatus, comprising:

a heater;

an endless film;

driving rotatable member for driving said endless film;

wherein a circumferential length of said driving rotatable member increases from its one end to the opposite end.

21. An apparatus according to claim 20, wherein said driving rotatable member drives an outer circumferential surface of said endless film.

22. An apparatus according to claim 21, wherein the recording material having the image is passed through a nip formed between said driving rotatable member and said endless film to heat the image.

23. An apparatus according to claim 20, further comprising a limiting member for limiting said endless film adjacent a large circumferential length side of said driving rotatable member.

24. An apparatus according to claim 23, wherein said limiting member limits a lateral edge of said film.

25. An apparatus according to claim 20, wherein the recording material is conveyed with its lateral end aligned with a conveyance reference, and the circumferential length of said driving rotatable member is larger adjacent the conveyance reference.

26. An apparatus according to claim 20, wherein said heater is stationary in use, and said film is in slidable contact with said heater.

27. An apparatus according to claim 20, wherein an unfixed image on the recording material is heated and fixed by heat from said heater through said film.

* * * * *